United States Patent [19]

Vollowitz

[11] Patent Number: 4,948,028

[45] Date of Patent: Aug. 14, 1990

[54] VARIABLE SIZE ENVELOPE WITH SINGLE CLOSURE FLAP

[75] Inventor: Robert S. Vollowitz, Agoura Hills, Calif.

[73] Assignee: Avery International Corporation, Pasadena, Calif.

[21] Appl. No.: 306,838

[22] Filed: Feb. 3, 1989

[51] Int. Cl.[5] ..... B65D 27/14

[52] U.S. Cl. ..... 229/80

[58] Field of Search ..... 229/80, 73, DIG. 3

[56] References Cited

U.S. PATENT DOCUMENTS

| | | | |
|---|---|---|---|
| Re. 20,615 | 1/1938 | Bear et al. . | |
| 22,405 | 12/1858 | Arnold . | |
| 50,549 | 10/1865 | Barrett . | |
| 180,200 | 7/1876 | Chapman . | |
| 225,319 | 3/1880 | Barton . | |
| 442,841 | 12/1890 | West . | |
| 494,170 | 2/1893 | Sewell . | |
| 512,505 | 1/1894 | Dale . | |
| 531,832 | 1/1895 | Brown . | |
| 660,141 | 10/1900 | Bartelmez . | |
| 693,624 | 2/1902 | Sallade . | |
| 730,933 | 6/1903 | Lanson . | |
| 754,373 | 3/1904 | Jones . | |
| 761,004 | 5/1904 | Meadows . | |
| 761,912 | 6/1904 | Rheutan . | |
| 783,365 | 2/1905 | Coleman . | |
| 985,061 | 2/1911 | Regenstein . | |
| 1,013,571 | 1/1912 | Stevens . | |
| 1,014,441 | 1/1912 | Benton . | |
| 1,045,001 | 11/1912 | Delffs . | |
| 1,091,172 | 3/1914 | Thayer . | |
| 1,110,939 | 9/1914 | Jones . | |
| 1,126,784 | 2/1915 | Kittka | 229/80 |
| 1,159,719 | 11/1915 | Shuman . | |
| 1,163,459 | 12/1915 | Rheutan . | |
| 1,164,606 | 12/1915 | Wittmann . | |
| 1,310,188 | 7/1919 | Hogan . | |
| 1,459,092 | 6/1923 | Etheridge . | |
| 1,529,264 | 3/1925 | Mayers . | |
| 1,957,704 | 5/1934 | Drachman | 229/73 |
| 2,142,374 | 1/1939 | Randolph . | |
| 2,152,135 | 3/1939 | Case et al. . | |
| 2,213,729 | 9/1940 | Anderson . | |
| 2,219,526 | 10/1940 | McLaren . | |

(List continued on next page.)

FOREIGN PATENT DOCUMENTS

| | | | |
|---|---|---|---|
| 691965 | 8/1964 | Canada . | |
| 43179 | 1/1982 | European Pat. Off. . | |
| 631006 | 5/1936 | Fed. Rep. of Germany . | |
| 951226 | 6/1947 | France . | |
| 2572364 | 8/1984 | France . | |
| 43404 | 5/1938 | Netherlands | 229/80 |
| 4768 | 3/1892 | Switzerland . | |
| 24562 | of 1903 | United Kingdom | 229/80 |
| 921378 | 3/1963 | United Kingdom . | |
| 1475304 | 6/1977 | United Kingdom . | |
| 2115744 | 9/1983 | United Kingdom . | |

*Primary Examiner*—Stephen P. Garbe

*Attorney, Agent, or Firm*—Poms,Smith,Lande & Rose

[57] ABSTRACT

A variable size envelope with a single closure flap that may be selectively folded along either of two different fold lines to provide two different sizes of envelopes. A pocket for holding papers or other documents may be formed by a single rear panel or two rear panels joined together. The height of the closure flap is preferably equal to the height of the panels so that the envelope when folded into a smaller size presents a flat envelope of uniform thickness which may be processed through automatic mechanical printing equipment, laser printing equipment and copying machines, then unfolded and later used as a larger size envelope. Adhesive strips are provided on the closure flap for the purpose of sealing the envelope. The adhesive used for the strips is preferably a stable, water-activated, or moisture-activated adhesive, which is not significantly affected by either heat or exposure to high humidity facilitating use of the envelope during laser printing or xerographic copying. A stable, pressure-sensitive adhesive covered by a peel-off strip may also be used for the adhesive strips on the closure flap.

29 Claims, 3 Drawing Sheets

U.S. PATENT DOCUMENTS 2,220,231 11/1940 Gilfillan ..... 229/80
2,304,523 12/1942 Young .
2,442,091 5/1948 Mann et al. .
2,610,784 9/1952 Henry .
3,063,618 11/1962 Berkowitz .
3,093,296 6/1963 Wood .
3,197,121 7/1965 Hayes, Jr. .
3,265,289 8/1966 Hiersteiner .
3,372,861 3/1968 Johnson et al. ..... 229/80
3,414,185 12/1968 Young .
3,428,237 2/1969 Dowen .
3,467,299 9/1969 Meyer .
3,557,519 1/1971 Lyon .
3,626,821 12/1971 Gendron .
3,648,923 3/1972 Young .
3,666,926 5/1972 Conte, Jr. et al. .
3,802,618 4/1974 Wiessner .
3,900,159 8/1975 Gendron .
3,937,492 2/1976 Biron .
4,004,728 1/1977 Ryan et al. .
4,031,818 6/1977 Kehoe .
4,044,942 8/1977 Sherwood .
4,128,954 12/1978 White .
4,199,630 4/1980 Consiglio .
4,305,506 12/1981 Greenwald .
4,313,557 2/1982 Foffel .
4,380,315 4/1983 Steidinger .
4,502,713 3/1985 Conti .
4,630,768 12/1986 Bradley .
4,715,531 12/1987 Stewart et al. .

FIG. 7
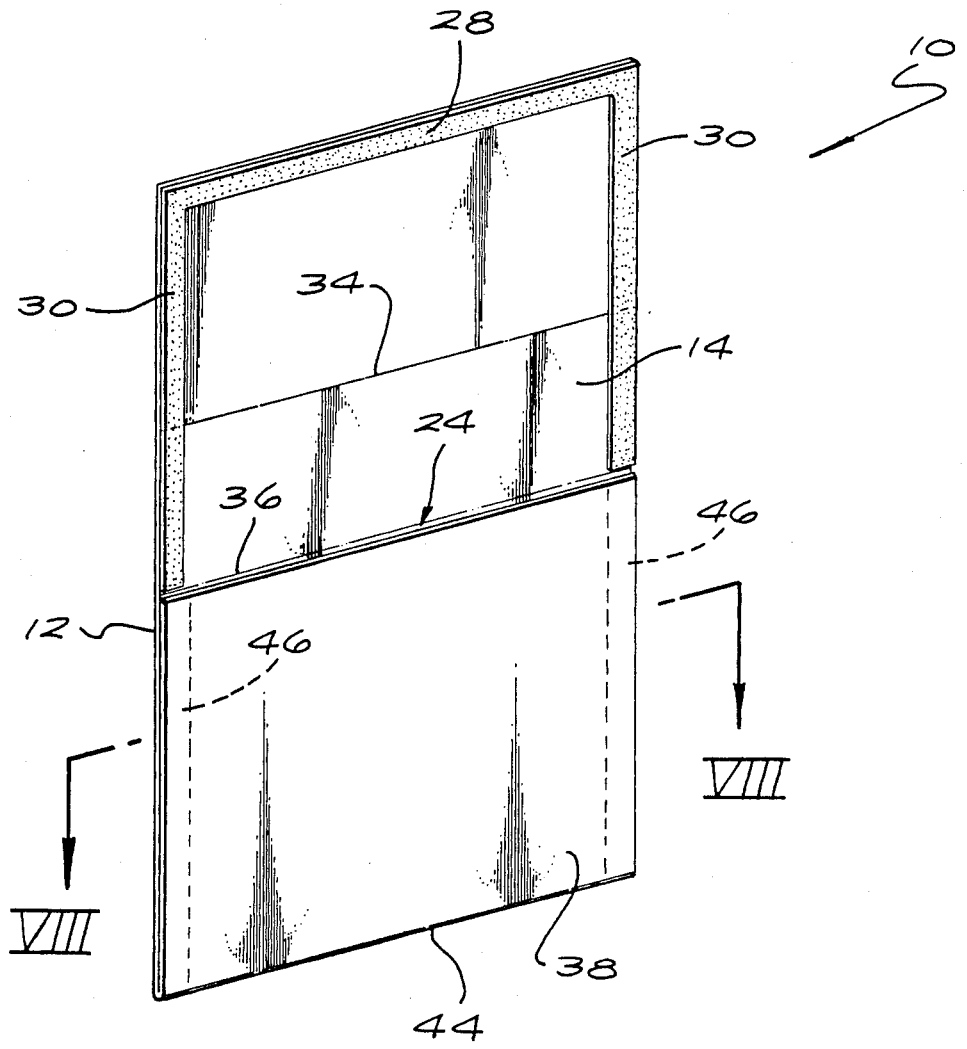
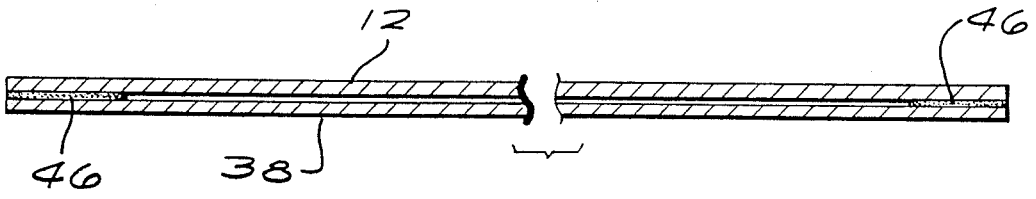
FIG. 8

VARIABLE SIZE ENVELOPE WITH SINGLE CLOSURE FLAP

CROSS-REFERENCE TO RELATED APPLICATION

The subject matter of this application is related to the subject matter of co-pending application, Ser. No. 07/005,458, filed by Wayne L. Rutkowski on Jan. 20, 1987, entitled "Dual Envelope Sheet Feed Assembly," and assigned to Avery International Corporation, the assignee of the present application is related to the subject matter of co-pending application, Ser. No. 07/270,785, filed by Tien-Tsung Chen, et al. on Nov. 14, 1988, entitled "Mailer For Laser Printer," and assigned to Avery International Corporation, the assignee of the present application; and is related to the subject matter of co-pending application, Ser. No. 07/344,615, filed by Kim Y. Kao, et al, on Apr. 27, 1989, entitled "Envelope With Single Peel-Off Backing Sheet to Facilitate Printing and Copying," and assigned to Avery International Corporation, the assignee of the present application.

BACKGROUND OF THE INVENTION

The present invention relates generally to envelopes and, more particularly, to a variable size envelope with a single closure flap that may be selectively folded along two different fold lines to provide two different size envelopes, the smaller envelope being of uniform thickness to facilitate processing through automatic mechanical sheet feed printing equipment, laser printing equipment and feed through copy machines.

In the past, envelopes of variable size have been difficult to process through automatic mechanical printing equipment, laser printing equipment and copying machines because the envelopes were either too big to send through such machines when folded into a larger size, or difficult to process when folded into a smaller size. For example, German Patent No. 631,006, issued to Bassler, et al. on June 10, 1936, discloses an envelope with a closure flap which may be folded along two different lines and sealed to provide envelopes of two different sizes. However, when folded into smaller size envelopes, the envelope disclosed in this patent presents folds through two thicknesses of material and overlapping portions near the top of the envelope which lead to an envelope of uneven thickness difficult to process through automatic mechanical printing equipment, laser printing equipment and copying machines. The expanding envelope disclosed in U.S. Pat. No. 3,063,618, issued to Berkowitz on Nov. 13, 1962, presents the same problems because it is not of uniform thickness when folded and has overlapping portions.

SUMMARY OF THE INVENTION

The above problems would be solved by a variable size envelope having a single closure flap which may be selectively folded along two different fold lines to provide two different envelopes, the smaller envelope being of uniform thickness so that it may be easily processed through automatic mechanical printing equipment, laser printing equipment and copying machines.

It is an object of this invention to provide a variable size envelope which may be selectively folded to present envelopes of two different sizes.

It is still another object of this invention to provide a variable size envelope which may be folded into a smaller size envelope of uniform thickness which may be easily processed through automatic mechanical sheet feed printing equipment, laser printing equipment and feed through copy machines.

It is still another object of this invention to provide a variable size envelope that is economical to manufacture.

These and other objects and advantages are attained by a variable size envelope with a single closure flap that may be selectively folded along either of two different fold lines to provide two different sizes of envelopes. A pocket for holding papers or other documents may be formed by a single rear panel or two rear panels joined together. The height of the closure flap is preferably equal to the height of the panels so that the envelope when folded into a smaller size presents a flat envelope of uniform thickness which may be processed through automatic mechanical printing equipment, laser printing equipment and copying machines, then unfolded and later used as a larger size envelope. Adhesive strips are provided on the closure flap for the purpose of sealing the envelope. The adhesive used for the strips is preferably a stable, water-activated, or moisture-activated adhesive, which is not significantly affected by either heat or exposure to high humidity, facilitating use of the envelope during laser printing or xerographic copying. A peel-off strip of material may be used to cover sticky adhesive on the closure flap. The sticky adhesive is preferably a stable, pressure-sensitive adhesive. The strip may be peeled from the flap so that the sticky adhesive can be used to seal the envelope shut.

The various features of the present invention will be best understood together with further objects and advantages by reference to the following description of the preferred embodiments taken in conjunction with the accompanying drawings.

BRIEF DESCRIPTION OF THE DRAWINGS

FIG. 7 is a rear perspective view of still another embodiment of the variable size envelope of the present invention having a rear panel attached to a front panel without the use of side flaps showing the closure flap of the envelope in an opened, unfolded position; and FIG. 8 is a cross-sectional view taken in the direction of arrows VIII—VIII shown in FIG. 7.

DESCRIPTION OF THE PREFERRED EMBODIMENTS

The following specification taken in conjunction with the drawings sets forth the preferred embodiments of the present invention in such a manner that any person skilled in the art can make and use the invention. The embodiments of the invention disclosed herein are the best modes contemplated by the inventors for carrying out their invention in a commercial environment although it should be understood that various modifications can be accomplished within the parameters of the present invention.

Figure 1:
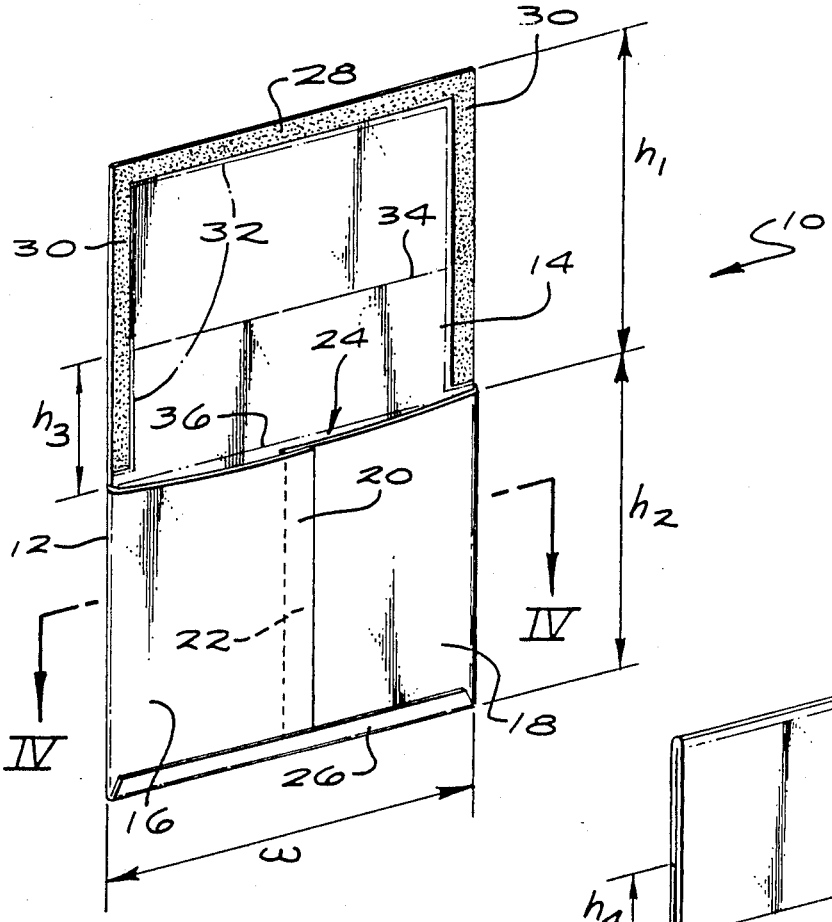
FIG. 1 is a rear perspective view of a variable size envelope having a central joint line provided by overlapping portions of two rear panels illustrating the principles of the present invention showing a closure flap of the envelope in an opened, unfolded position.

FIGS. 1 through 4 show an embodiment of the variable size envelope 10 of the present invention. The envelope 10 has a front panel 12 with an integrally formed closure flap 14 shown in an opened, unfolded position in FIG. 1 and two integrally formed rear panels 16 and 18. Panels 12, 16 and 18 and closure flap 14 are made of sheets of material such as paper. Panels 16 and 18 have overlapping portions 20 and 22, respectively, which are joined together by glue or some type of adhesive along a central joint line to form a pocket 24 for holding papers, documents or other materials. A bottom flap 26 is glued or sealed by some type of adhesive to the bottoms of panels 16 and 18 as shown in FIG. 1 closing the bottom of pocket 24.

Closure flap 14 has horizontal and vertical strips of glue or other adhesive 28 and 30, respectively, at the top and sides thereof as shown in FIG. 1. The vertical strips of adhesive 30 preferably extend all the way down the sides of the flap 14 to the top of pocket 24. However, the strips of adhesive 30 may extend only part of the way down the sides of flap 14 if desired. If the envelope 10 is not subjected to higher temperatures during laser printing or by the hot rollers of a xerographic copying machine, then "natural" gum adhesives may be used for the adhesive 28 and 30. However, if the envelope 10 is intended for laser printing or xerographic copying, then the relatively high temperature of a few hundred degrees Fahrenheit encountered during these operations will cause a gum adhesive to become sticky, resulting in contamination to the printer or copier. Therefore, if the envelope 10 will be used for laser printing or xerographic copying, a stable, water-activated, or moisture-activated adhesive is desirable, which is not significantly affected by either heat or exposure to high humidity. One such adhesive is available from Adhesive Consultants Corporation, 25817 Clawiter Road, Hayward, Calif. 94545, under the trade name "Adcon FS-6." The adhesive is a polyvinyl emulsion. However, other stable moisture-activated adhesives are known, and such other adhesives may be used if desired.

A peel-off strip 32 represented by dotted lines in FIG. 1 may also be used to cover a sticky adhesive such as 28 and 30 and peeled off for the purpose of adhering the flap 14 to the panels 16 and 18. The peel-off strip 32 is preferably covered by a release material such as silicone so that it may be easily removed from the sticky adhesive 28 and 30. Moreover, the sticky adhesive 28 and 30 is preferably a stable, pressure-sensitive adhesive of a type which will not flow at a temperature of a few hundred degrees Fahrenheit. Preferably, both the pressure-sensitive adhesive and water-activated adhesive will remain stable when subjected to temperatures in the range of up to about 300 to about 400 degrees Fahrenheit.

It is important to note that the invention is not intended to be limited by the type of adhesive used or by the location of the adhesive on the flap 14. For example, the entire upper half of the flap 14 may be covered by adhesive, or only one strip 28 of adhesive may be used if desired.

Figure 2:
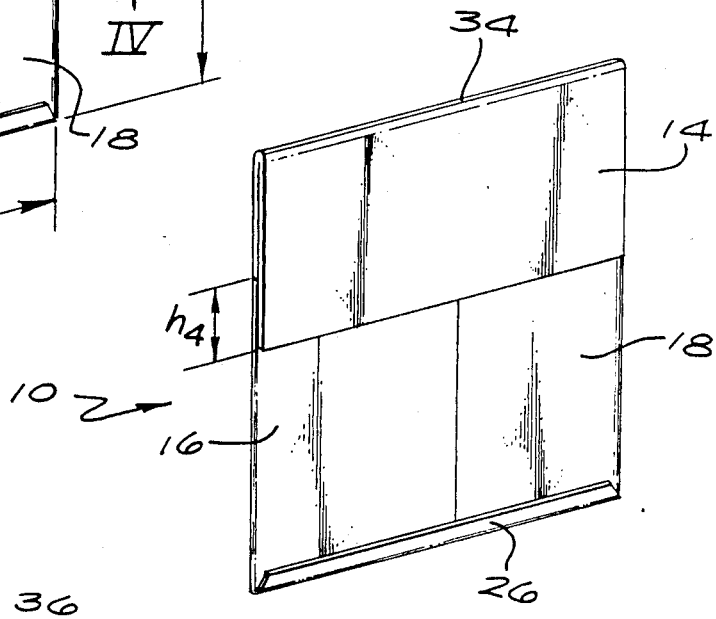
FIG. 2 is a rear perspective view of the envelope of FIG. 1 with the closure flap folded along an upper fold line to provide a larger size envelope.

The flap 14 may be selectively folded along fold lines 34 and 36 to provide envelopes 10 of different sizes. FIG. 2 shows the envelope 10 after the flap 14 has been folded along fold line 34 to present a larger size envelope 10. Adhesive strips 28 and 30 are used to attach the portion of closure flap 14 above line 34 to rear panels 16 and 18 and to the portion of flap 14 below line 34. If a strip 32 is used, then the strip 32 is peeled off flap 14 and the sticky adhesive below the strip 32 is used to hold the flaps 14 in place.

Figure 3:
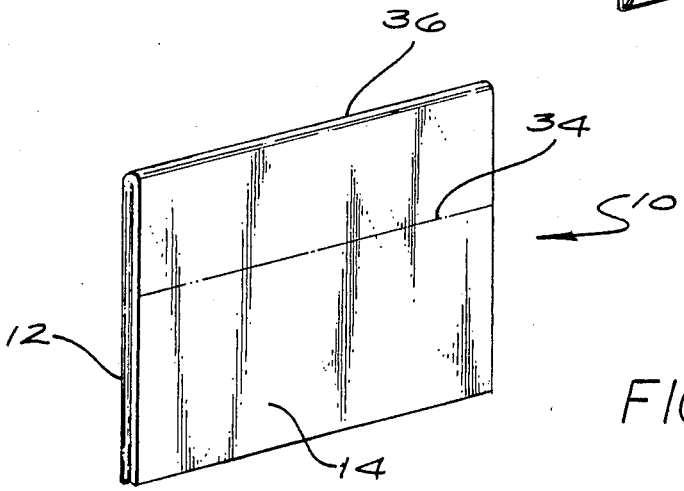
FIG. 3 is a rear perspective view of the envelope of FIG. 1 with the closure flap folded along a lower fold line to provide a smaller size envelope.
Figure 4:
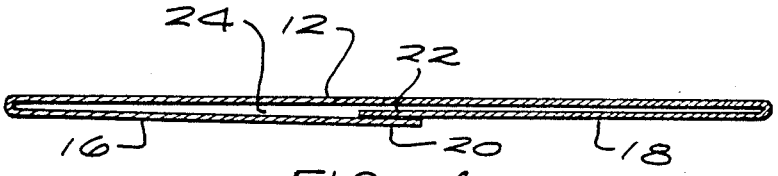
FIG. 4 is a cross-sectional view taken in the direction of arrows IV—IV shown in FIG. 1.

A smaller size envelope 10 may be obtained by folding closure flap 14 along line 36 and by using adhesive strips 28 and 30 to adhere the flap 14 to the panels 16 and 18 as shown in FIG. 3. Note that the height $h_1$ of closure flap 14 is preferably sized to be approximately the same size as the height $h_2$ of the panels 16 and 18. As a result, the smaller size envelope 10 is of uniform thickness when folded as shown in FIG. 3, which facilitates passing the envelope through automatic mechanical sheet feed printing equipment, laser printing equipment and feed through copying machines or equipment. Moreover, the envelope 10 may be folded as shown in FIG. 3 without sealing or using adhesive strips 28 and 30 to attach the closure flap 14 to the panels 16 and 18. In other words, after the smaller unsealed envelope 10 has addresses or other indicia printed thereon, or has been copied, it may be unfolded and then flap 14 may be folded along line 34 and the adhesive strips 28 and 30 used to seal the larger sized envelope 10 shut. As such, the smaller sized envelope 10 provides a flat envelope of uniform thickness which may be used for the purpose of putting printing on a larger size envelope 10 that is too large to be processed by automatic mechanical printing equipment or laser printing equipment. The uniform thickness also facilitates feeding the envelope 10 through copying machines.

Preferably, $h_1$ and $h_2$ equal about $8\frac{1}{2}$inches and the width, W, of the envelope 10 is preferably about $9\frac{3}{4}$ inches to facilitate processing through automatic mechanical sheet feed printing equipment, laser printing equipment and feed through copy machines. As a result, the smaller envelope 10 is $8\frac{1}{2}$ inches by $9\frac{3}{4}$ inches and the size of the larger envelope 10 is about 12 inches by $9\frac{3}{4}$ inches. In addition, fold line 34 should be located at a height $h_3$ above the top of pocket 24 that is less than half the height $h_1$ so that flap 14 overlaps the top of pocket 24 by distance $h_4$ when folded as shown in FIG. 2. $h_3$ is preferably about $3\frac{1}{2}$ inches making $h_4$ about $1\frac{1}{2}$ inches. However, it is important to point out that the dimensions $h_1$, $h_2$, $h_3$, $h_4$ and W may vary as desired to provide envelopes 10 of any desirable size. It is intended that this invention not be limited by the size of envelope 10.

Figure 5:
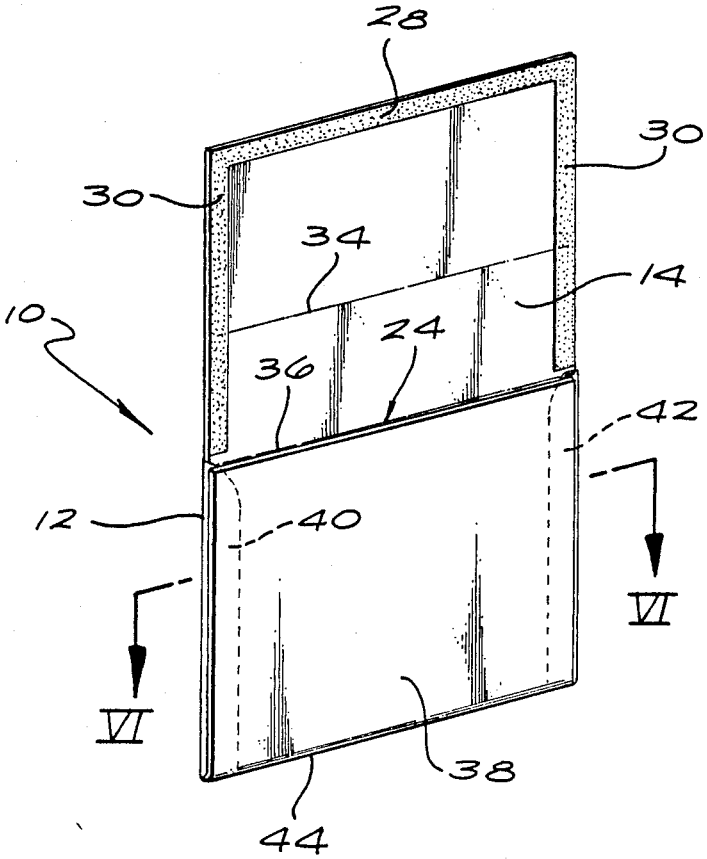
FIG. 5 is a rear perspective view of another embodiment of the variable size envelope of the present invention having a rear panel attached to two side flaps showing the closure flap of the envelope in an opened, unfolded position.
Figure 6:
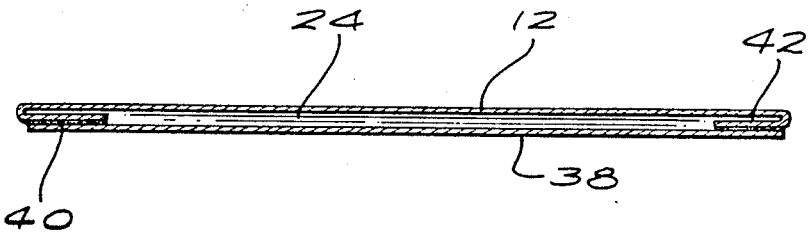
FIG. 6 is a cross-sectional view taken in the direction of arrows VI—VI shown in FIG. 5.

FIGS. 5 and 6 show another embodiment of the variable size envelope 10 of the present invention. The envelope 10 has a single rear panel 38 that is joined to two side flaps 40 and 42 of the front panel 12 by glue or any suitable adhesive for the purpose of providing pocket 24 for holding papers, documents, etc. Alternatively, the side flaps 40 and 42 may be part of the rear panel 38 instead of the front panel 12 if desired. Note that the bottom flap 26 of the envelope 10 shown in FIGS. 1 and 2 is eliminated by the single rear panel 38 which folds upward along line 44. The remaining portions of the envelope 10 are similar to those of the embodiment shown in FIG. 1.

Still another embodiment of the variable size envelope 10 of the present invention is shown in FIGS. 7 and 8. The envelope 10 has rear panel 38 folded upward along line 44 to form pocket 24. The vertical sides of panel 38 are joined to vertical sides of front panel 12 by strips of glue or other suitable adhesive 46. The rest of the envelope 10 is similar to the embodiments shown in FIGS. 1 and 5.

The envelope 10 described above is of variable size, i.e., closure flap 14 may be selectively folded along either of lines 34 and 36 to provide larger and smaller envelopes as desired. In addition, the folding feature of the envelope 10 allows the envelope to be printed using automatic mechanical printing equipment or laser printing equipment when folded into the smaller size envelope of uniform thickness and subsequently unfolded and later used as a larger size envelope after addresses, etc. have been printed on the envelope. Copying is also simplified by the smaller size envelope 10 of uniform thickness.

The above description discloses the preferred embodiments of the present invention. However, persons of ordinary skill in the art are capable of numerous modifications once taught these principles. For instance, by way of example and not limitation, a single back panel may be folded about a vertical fold line at one side of the envelope and attached to a single flap at the opposite side of the envelope. Also, the adhesive may be attached to the back panel or panels rather than to the closure flap. Other flap designs may also be used in place of those described above. Accordingly, it will be understood by those skilled in the art that changes in form and details may be made to the above-described embodiments without departing from the spirit and size of the invention.

I claim:

1. A variable size envelope comprising a front panel joined to at least one rear panel to form a pocket and a closure flap joined to said front panel, said closure flap having a height approximately equal to a height of said rear panel, said closure flap having a first fold line adjacent a top of said rear panel, said closure flap adapted to be folded along said first line to provide a flat, small envelope of approximately uniform thickness facilitating processing through printing and copying equipment, said closure flap having a second fold line located between a top of said closure flap and said top of said rear panel, said envelope adapted to be unfolded from said small envelope so that said closure flap may be folded along said second fold line to provide a flat, large envelope larger in size than said small envelope.

2. The variable size envelope of claim 1 further comprising strips of adhesive on said closure flap capable of being used to seal said envelope shut.

3. The variable size envelope of claim 2 wherein said envelope has two of said rear panels, said rear panels having overlapping portions thereof, said rear panels being joined together at said overlapping portions.

4. The variable size envelope of claim 2 wherein said envelope has one said rear panel folded upward from a bottom of said envelope, said rear panel having opposite vertical sides, said front panel having opposite vertical sides and side flaps joined to said front panel along said vertical sides of said front panel, said vertical sides of said rear panel being joined to said side flaps of said front panel.

5. The variable size envelope of claim 2 wherein said envelope has one said rear panel folded upward from a bottom of said envelope, said rear panel and said front panel having opposite vertical sides, said vertical sides of said rear penal being joined to said vertical sides of said front panel by adhesive.

6. The variable size envelope of claim 2 wherein said second fold line is located less than halfway up said height of said closure flap.

7. The variable size envelope of claim 6 wherein said adhesive strips are located both above and below said second fold line

8. The variable size envelope of claim 7 wherein said adhesive strips include one horizontal strip adjacent said top of said closure flap and a vertical strip adjacent each side of said closure flap, and said vertical strips extending from said top of said closure flap to said top of said rear panel.

9. The variable size envelope of claim 8 wherein said adhesive is a stable, water-activated adhesive which is not activated by a temperature of about a few hundred degrees Fahrenheit and by high humidity conditions.

10. The variable size envelope of claim 8 wherein said adhesive is a stable, water-activated adhesive which is not activated by a temperature in the range of up to about 300 to about 400 degrees Fahrenheit and by high humidity conditions.

11. The variable size envelope of claim 9 wherein said stable, water-activated adhesive is a polyvinyl emulsion.

12. The variable size envelope of claim 7 wherein each of said adhesive strips is a stable, pressure-sensitive adhesive covered by a peel-off strip.

13. The variable size envelope of claim 12 wherein said stable, pressure sensitive adhesive is not activated by a temperature of about a few hundred degrees Fahrenheit.

14. The variable size envelope of claim 12 wherein said stable, pressure sensitive adhesive is not activated by a temperature in the range of up to about 300 to about 400 degrees Fahrenheit.

15. A variable size envelope comprising a front panel having opposite vertical sides, said front panel being joined to two rear panels forming a pocket with each of said rear panels being folded at one of said opposite vertical sides so that the ends of said rear panels are joined together at overlapping portions thereof aligned with a vertical line passing through a midpoint of said envelope, and a closure flap having a height approximately equal to a height of said rear panels, said closure flap having adhesive strips thereon capable of being used to seal said envelope shut, said closure flap having a first fold line adjacent a top of said rear panels, said closure flap adapted to be folded along said first fold line to provide a flat, small envelope of approximately uniform thickness facilitating processing through printing and copying equipment, said closure flap having a second fold line located between a top of said closure flap and said top of said rear panels, said envelope adapted to be unfolded from said small envelope so that said closure flap may be folded along said second fold line to provide a flat, large envelope larger in size than said small envelope.

16. The variable size envelope of claim 15 wherein said second fold line is located less than halfway up said height of said closure flap.

17. The variable size envelope of claim 16 wherein said adhesive strips are located both above and below said second fold line.

18. The variable size envelope of claim 17 wherein said adhesive is a stable, water-activated adhesive.

19. The variable size envelope of claim 17 wherein each of said adhesive strips is a stable, pressure-sensitive adhesive covered by a peel-off strip.

20. A variable size envelope comprising a front panel joined to a rear panel folded upward from a bottom of said envelope to form a pocket, said rear panel and said front panel having opposite vertical sides, said rear panel joined to side flaps at said opposite vertical sides of said front panel, and a closure flap having a height approximately equal to a height of said rear panel, said closure flap having adhesive strips thereon capable of being used to seal said envelope shut, said closure flap having a first fold line adjacent a top of said rear panel, said closure flap adapted to be folded along said first fold line to provide a flat, small envelope of approximately uniform thickness facilitating processing through printing and copying equipment, said closure flap having a second fold line located between a top of said closure flap and said top of said rear panel, said envelope adapted to be unfolded from said small envelope so that said closure flap may be folded along said second fold line to provide a flat, large envelope larger in size than said small envelope.

21. The variable size envelope of claim 20 wherein said second fold line is located less than halfway up said height of said closure flap.

22. The variable size envelope of claim 21 wherein said adhesive strips are located both above and below said second fold line.

23. The variable size envelope of claim 22 wherein said adhesive is a stable, water-activated adhesive.

24. The variable size envelope of claim 22 wherein each of said adhesive strips is a stable, pressure-sensitive adhesive covered by a peel-off strip.

25. A variable size envelope comprising:

a front panel;

at least one rear panel joined to said front panel forming a pocket; and closure flap means joined to said front panel for selectively folding said envelope into a flat, small size envelope of uniform thickness and selectively folding said envelope into a flat, large size envelope, said large size envelope larger than said small size envelope, said flat, small size envelope facilitating processing through printing and copying equipment, said closure flap means having a height approximately equal to a height of said rear panel, said closure flap means for selectively unfolding said envelope from said small size envelope and subsequently folding said envelope into said large size envelope so that said envelope may be sealed shut, said closure flap means including a first fold line adjacent a top of said rear panel and a second fold line located between said top of said rear panel and a top of said closure flap, said closure flap adapted to be folded along said first fold line to form said small size envelope and adapted to be folded along said second fold line to form said large size envelope.

26. A variable size envelope comprising:

a front panel;

at least one rear panel joined to said front panel forming a pocket; and closure flap means joined to said front panel for selectively folding said envelope into a flat, small size envelope of uniform thickness and selectively folding said envelope into a flat, large size envelope, said large size envelope larger than said small size envelope, said flat, small size envelope facilitating processing through printing and copying equipment, said closure flap means having a height approximately equal to a height of said rear panel, said closure flap means for selectively unfolding said envelope from said small size envelope and subsequently folding said envelope into said large size envelope so that said envelope may be shut, said closure flap means comprising a sheet of material joined to said front panel adjacent a top of said rear panel, said sheet having a first fold line adjacent said top of said rear panel and a second fold line located less than halfway up said height of said sheet between said top of said rear panel and a top of said sheet, said sheet having adhesive strips thereon capable of being used to seal said envelope shut.

27. The variable size envelope of claim 26 wherein said adhesive strips are located both above and below said second fold line.

28. The variable size envelope of claim 27 wherein said adhesive is a stable, water-activated adhesive.

29. The variable size envelope of claim 27 wherein each of said adhesive strips is a stable, pressure-sensitive adhesive covered by a peel-off strip.

* * * * *